US005810683A

United States Patent [19]

Davis

[11] Patent Number: 5,810,683

[45] Date of Patent: Sep. 22, 1998

[54] MORPH FRAME FOR SPORTS RACQUET

[75] Inventor: Stephen J. Davis, Washington Crossing, Pa.

[73] Assignee: Prince Sports Group, Inc., Bordentown, N.J.

[21] Appl. No.: 773,208

[22] Filed: Dec. 23, 1996

[51] Int. Cl.[6] ..... A63B 49/02

[52] U.S. Cl. ..... 473/546; 473/537

[58] Field of Search ..... 473/524, 537, 473/546, 181, 177

[56] References Cited

U.S. PATENT DOCUMENTS

| | | | |
|---|---|---|---|
| 3,809,402 | 5/1974 | Haines et al. . | |
| 4,561,655 | 12/1985 | Mortvedt | 473/537 |
| 4,664,380 | 5/1987 | Kuebler | 473/546 X |
| 4,997,186 | 3/1991 | Carr . | |
| 5,076,583 | 12/1991 | Hsu | 473/537 |
| 5,080,361 | 1/1992 | Blanc et al. | 473/537 |
| 5,158,288 | 10/1992 | Chen et al. | 473/537 |
| 5,312,102 | 5/1994 | Stennett | 473/537 |
| 5,470,061 | 11/1995 | Colburn et al. | 473/537 |

FOREIGN PATENT DOCUMENTS

| | | | |
|---|---|---|---|
| 4037567 | 5/1992 | Germany | 473/181 |

OTHER PUBLICATIONS

Maxima 1988 catalog, Collexione 1988, showing Profile tennis racquet.

Photocopy of 1991 Maxima Profiline Mid tennis racquet (throat region).

Photocopy of Kneissl White Star Twin racquet (throat region), date unknown, admitted prior art.

Gillaume Barcelion racquet, 1753.

Tropical Eagle wood tennis racquet, date unknown, admitted prior art.

Defender wooden racquet, 1920's.

Dayton Steel metal racquets, date unknown, admitted prior art.

Ambassador wood racquet, Draper & Maynard, 1920's.

Harry Lee model "The Bat" 1920's.

Lee model Dreadnought Driver C. 1920.

Magnan Superior, late 1920's.

Reach flat–top racquet, circa 1885.

Super Stroke, Wilson, 1920's.

Wilson model, The Championship, 1920's.

Reach Contender, 1915.

*Primary Examiner*—Raleigh W. Chiu

*Attorney, Agent, or Firm*—White & Case L.L.P.

[57] ABSTRACT

A sports racquet, preferably a tennis racquet, includes an open throat frame in which at least most of the head portion has an aerodynamic cross-section, and at least most of the shaft portions have a box-like cross-section, the two regions being connected by a morph region for smoothly blending the cross-section of one region into the cross-section of the other region. Preferably, the morph region extends from the throat bridge toward the racquet tip, and the transition from the box-like cross-section to the aerodynamic cross-section occurs over a distance of less than 15% of the overall racquet length and substantially simultaneously with the merging of the ends of the throat bridge into the head portion of the racquet.

10 Claims, 4 Drawing Sheets

MORPH FRAME FOR SPORTS RACQUET

FIELD OF INVENTION

The present invention relates to sports racquets. While a preferred embodiment is described in relation to a tennis racquet, the principles of the invention may be applied to other types of sports racquets such as squash racquets, badminton racquets, and racquetball racquets.

BACKGROUND OF THE INVENTION

Composite tennis racquet frames generally have one of two types of cross-sections, a box-type cross-section or an aerodynamic cross-section.

The box-type cross-section used in composite racquets is a shape that originated in the 1970's, when composite tennis racquets were first introduced. An example of a tennis racquet with a box-type cross-section was the original Prince Graphite tennis racquet, which is illustrated in FIGS. 1–5. As shown therein, the Prince Graphite racquet frame had generally flat sides 10, and flat top 12 and bottom 14 surfaces. The frame had a height "h" of 19 mm and a cross-sectional width "w" of 12 mm. This boxy (i.e., generally rectangular) cross-section was generally constant throughout the frame and throat bridge 15, except that a stringing groove 16 was formed in the head section 18 of the frame.

The boxy cross-section is still very popular today because it provides a good combination of bending and torsional stiffness properties. Also, it provides a very quiet feel for the racquet and is stable at impact. For such reasons, better players tend to prefer the boxy cross-section.

Aerodynamic cross-sections differ from the box-type cross-section in that they are generally higher in height, more narrow in width, and shaped in a manner to create less wind resistance when the racquet is swung. FIGS. 6–7 show cross-sections of a typical prior art wide body tennis racquet with an aerodynamic frame, at positions on the frame comparable to lines 3—3 and 4—4 of FIG. 1. Instead of flat sides and flat top and bottom surfaces, the aerodynamic cross-section has radiused sides 20, and the top 22 and bottom 24 surfaces (one of which forms the leading edge of the frame when the racquet is swung) are either curved or have at most only a very small flat area. As shown, the cross-section in the head portion of the frame is the same as the shaft, except that a stringing groove 26 is formed in the head portion in the customary manner.

Today, both types of tennis racquets are sold. Aerodynamic cross-sections offer greater bending stiffness due to the greater height of the cross-section, and are used on racquets where players desire greater power. The boxy cross-section, while producing less return power, offers greater torsional stiffness should the ball land to either side of the centerline of the string bed, and provides a greater sense of feel, and for such reasons is utilized in tennis racquets where more control is desired.

SUMMARY OF THE INVENTION

A sports racquet, preferably a tennis racquet, according to the invention includes an open throat frame in which at least most of the head portion has an aerodynamic cross-section, and at least most of the shaft portions have a box-like cross-section, the two regions being connected by a transition, or "morph" region for smoothly blending, or "morphing", the cross-section of one region into the cross-section of the other region.

Preferably, the morph region is located adjacent the throat bridge and, most preferably, lies substantially between the throat bridge and the tip end of the racquet so that the transition from boxy to aerodynamic cross-sections occurs simultaneously with the merging of the ends of the throat bridge into the main frame tube. Also, preferably the morph region extends no more than 15%, and most preferably only about 10%, of the length of the racquet, such that at least most of the head portion has an aerodynamic cross-section and at least most of the shaft portions have a box-like cross-section.

As used herein, the term "aerodynamic cross-section" means a frame cross-section having:

- a height-to-width ratio, or "aspect ratio" (height being the dimension perpendicular to the stringing plane; width being the dimension in the stringing plane) greater than 2:1;
- a height greater than 22 mm;
- a width less than 12 mm;
- top and bottom surfaces which are either curved or which have a flat section less than 5 mm wide; and
- sides defined by a radius less than 50 mm.

As used herein, a box-type cross-section means a frame cross-section having:

- an aspect ratio less than 2:1;
- a height less than 24 mm;
- a width greater than 10 mm;
- a flat at the top and bottom of the cross-section greater than 2 mm; and
- sides having a region of at least 5 mm (measured in a direction from top to bottom of the cross-section) which is either flat or defined by a radius greater than 50 mm.

In a preferred embodiment, the cross-sectional height in the aerodynamic region of the frame is at least 15% greater than the cross-sectional height in the box-like region. Also, preferably, the cross-sectional width in the box-like region is approximately 140% of the cross-sectional width in the aerodynamic region.

A racquet according to the present invention offers a number of benefits, in terms of improved performance and playability, compared with racquets presently on the market. When a ball impacts the string bed, the racquet exhibits good stability, and provides a quiet feel and good control, due to the box-like cross-section in the throat region. At the same time, the aerodynamic shape of the frame in the head portion of the racquet provides greater power and stiffness, along with lower wind resistance (which is more important in the head than in the throat region, because the head experiences a higher velocity during a swing than the throat due to the rotation point of the racquet). The box-like cross-section in the throat region and aerodynamic cross-section in the head portion of the racquet also act together to provide good overall torsional stiffness, to resist bending to improve frame stiffness, and to increase the size of the power zone.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
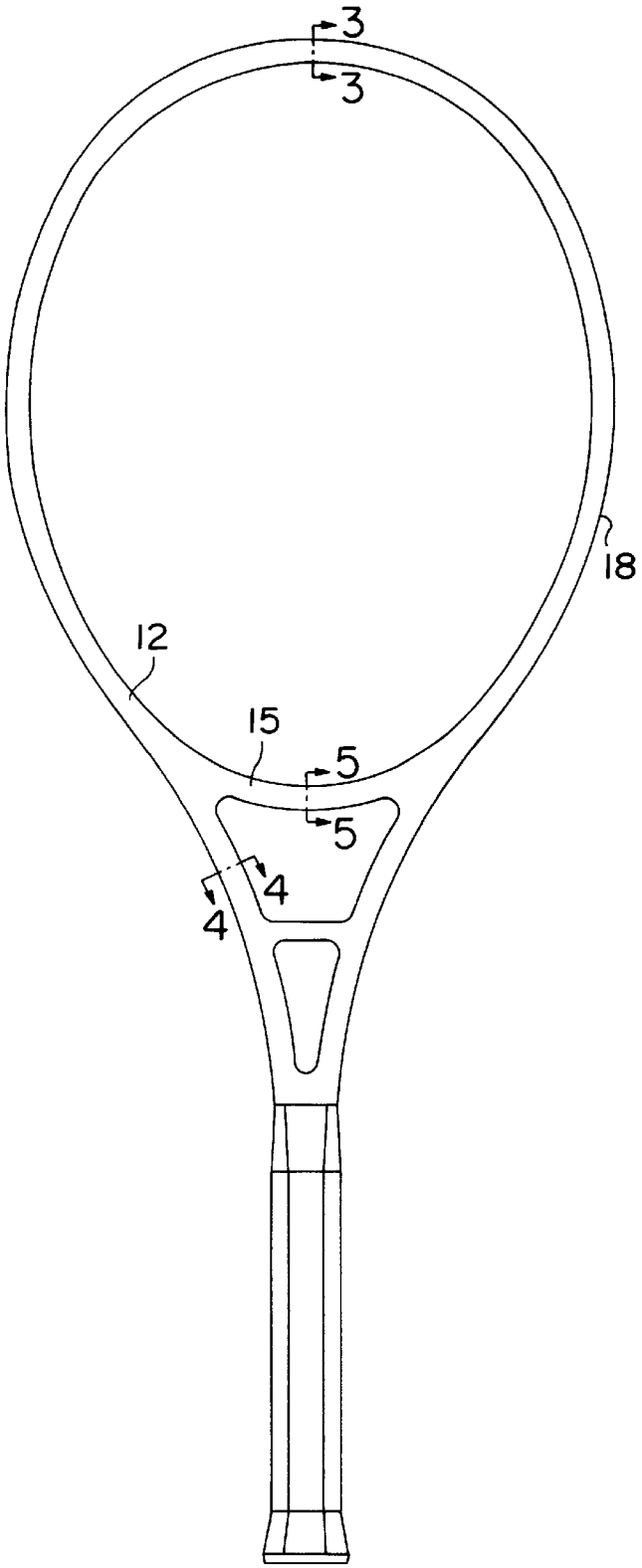
FIG. 1 PRIOR ART
FIGS. 1 and 2 are front and side views, respectively, of a prior art Prince Graphite tennis racquet.
Figure 2:
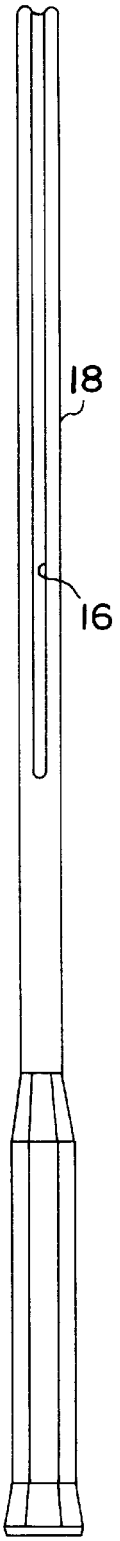
FIG. 2 PRIOR ART
Figure 3:
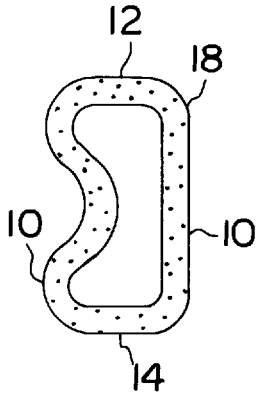
FIG. 3 PRIOR ART
FIGS. 3–5 are enlarged, cross-sectional views of the racquet of FIGS. 1–2, taken through lines, 3—3, 4—4, and 5—5, respectively, of FIG. 1.
Figure 4:
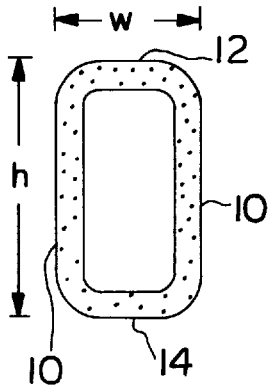
FIG. 4 PRIOR ART
Figure 5:
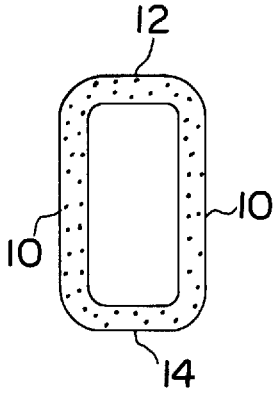
FIG. 5 PRIOR ART
Figure 6:
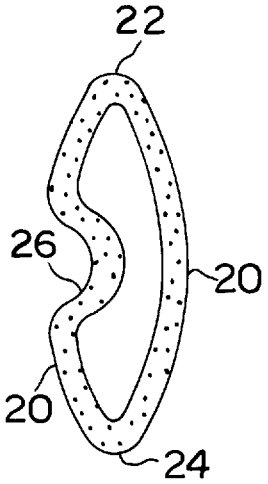
FIG. 6 PRIOR ART
FIGS. 6–7 are enlarged, cross-sectional views of a typical prior art wide body tennis racquet, taken at positions on the frame comparable to lines 3—3 and 4—4 of FIG. 1.
Figure 7:
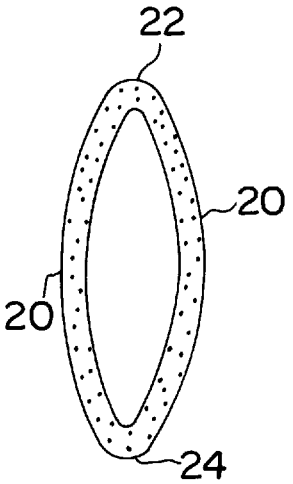
FIG. 7 PRIOR ART

A tennis racquet according to the invention includes a head portion 30 which is formed of bowed frame tube made of a composite material, such as "graphite", and which may be provided with a conventional stringing groove 33. A pair of converging shafts 31, forming a throat region, extend from the ends of the head portion 30 opposite the tip 32, and join a handle portion 34. Finally, a throat bridge 36 spans the upper ends of the shafts 31 to complete a strung surface region 38 that contains interwoven strings (not shown).

The handle portion 34 may be any suitable configuration. For example, the handle portion 34 may include an octagonal shape cushion pallet that slides over the handle portion of the frame, such as disclosed in Nolan U.S. Pat. No. 5,034,082 or Uke et al. U.S. Pat. No. 5,042,804, or the interchangeable handle disclosed in commonly owned Davis et al. U.S. Patent application Ser. No. 08/415,348. Alternatively, the racquet frame, in the handle area, may be molded into an octagonal shape, such that the graphite frame itself forms a hollow, molded-in handle 34, such as disclosed in Jenks U.S. Pat. No. 3,993,308.

The racquet frame has three regions: region "A", extending from the tip 32 toward the handle 34, where the frame has an aerodynamic cross-section; region "B", extending from the top of the handle 34 towards the tip 32, where the frame has a box-type cross-section; and a transition, or morph region "M" where one cross-section is blended into the other cross-section.

Figure 10:
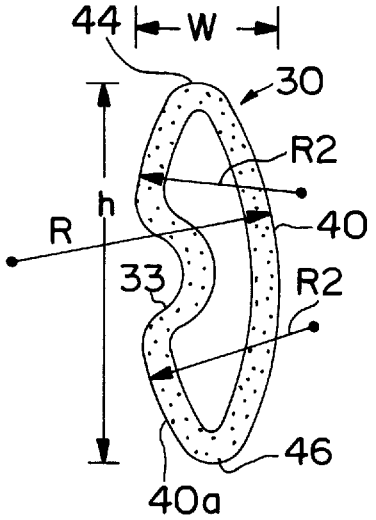
FIGS. 10–14 are enlarged, cross-sectional views of the racquet of FIGS. 8–9, taken through lines, 10—10, 11—11, 12—12, 13—13, and 14—14, respectively, of FIG. 8.

As shown in FIG. 10, in region A, the frame 30 has a height "h" which is substantially greater than the width "w". The sides 40, 40*a* of the frame 30 are radiused, and the top 42 and bottom 44 surfaces are generally curved, with only a small flat region. The inner side 40 of the frame (i.e., the side that faces the strung surface area 38) has a radius of curvature "R1" of approximately 27 mm. The outwardly facing side 40*a* of the frame has a radius of curvature R2 (except in the stringing groove 33) of approximately 15 mm. The top and bottom surfaces 44, 46 have a flat area which is only 0.4 mm wide, and to either side of the flat area such surfaces 44, 46 have a curvature radius of 2 mm.

In the exemplary embodiment, the frame 30, in the region "A" (i.e., from the tip 32 to the cross-section 11—11), has a constant height "h" of 28 mm. Between the 12 o'clock position and the 3 o'clock and 9 o'clock positions, the cross-sectional width "w" increases continuously, from 10 mm at the tip 32 to 12 mm at the 3 and 9 o'clock positions. Finally, between the 3 o'clock and 9 o'clock positions and the cross-section 11—11 (until reaching the boundary of region "M"), the height and width are constant. The foregoing is merely exemplary, however, and if desired other dimensions and shapes, including uniform cross-sections, may be utilized in the region extending from the tip 32, provided that the shape remains aerodynamic.

Figure 13:
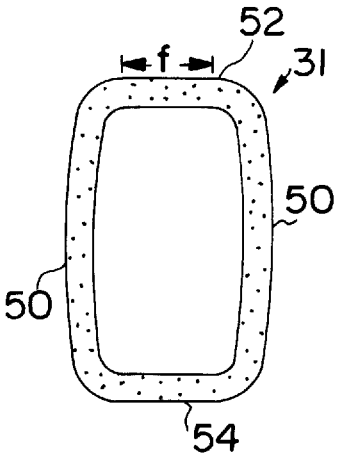

Referring to FIG. 13, in region "B" the frame 31 has a box-type cross-section. In the exemplary embodiment, the frame has a height of 23.5 mm and a width of 14.5 mm. The sides 50 have a radius of curvature of 75 mm, and thus are generally flat. The top and bottom surfaces 52, 54 have flat regions "f" approximately 4 mm wide. As in the case of the aerodynamic region, the foregoing dimensions and shape are exemplary, and other box-type cross-sections may be employed.

Figure 11:
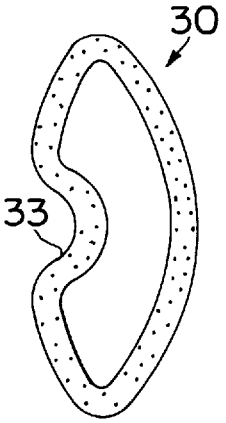
Figure 12:
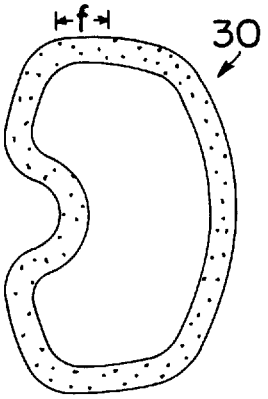

FIGS. 11 and 12 illustrate the frame cross-section in the morph region "M". In FIG. 11, the cross-section is slightly wider than in the tip 32, but is still aerodynamic. By the time the frame reaches the position represented by FIG. 12, the frame has become substantially greater in width and shorter in height, with a flat region "f" approximately 2.8 mm wide. In the exemplary embodiment, in FIG. 11 the frame has a height of 28 mm and a width of 12 mm. In FIG. 12, the height has decreased to 26 mm, and the width has further increased. The increase in width is due partly to an increase in frame width, and partly to the increased wall thickness resulting from additional graphite material wraps which are used to secure the ends 60 of the throat bridge to the main frame tube 30. In the morph region "M", i.e., between locations 11—11 and 12—12, the height decreases, while the width increases, continuously and smoothly, with the curvatures of the outside frame surface changing smoothly accordingly.

Figure 14:
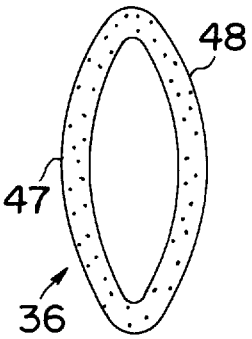

The throat bridge 36 is shown in FIG. 14, and in the exemplary embodiment has a height of 20 mm and a width of 11 mm. In the example, the inwardly facing side 47 and outwardly facing side 48 are curved. The throat bridge 36 shown in FIG. 14 is merely illustrative, and various shapes may be employed.

Figure 8:
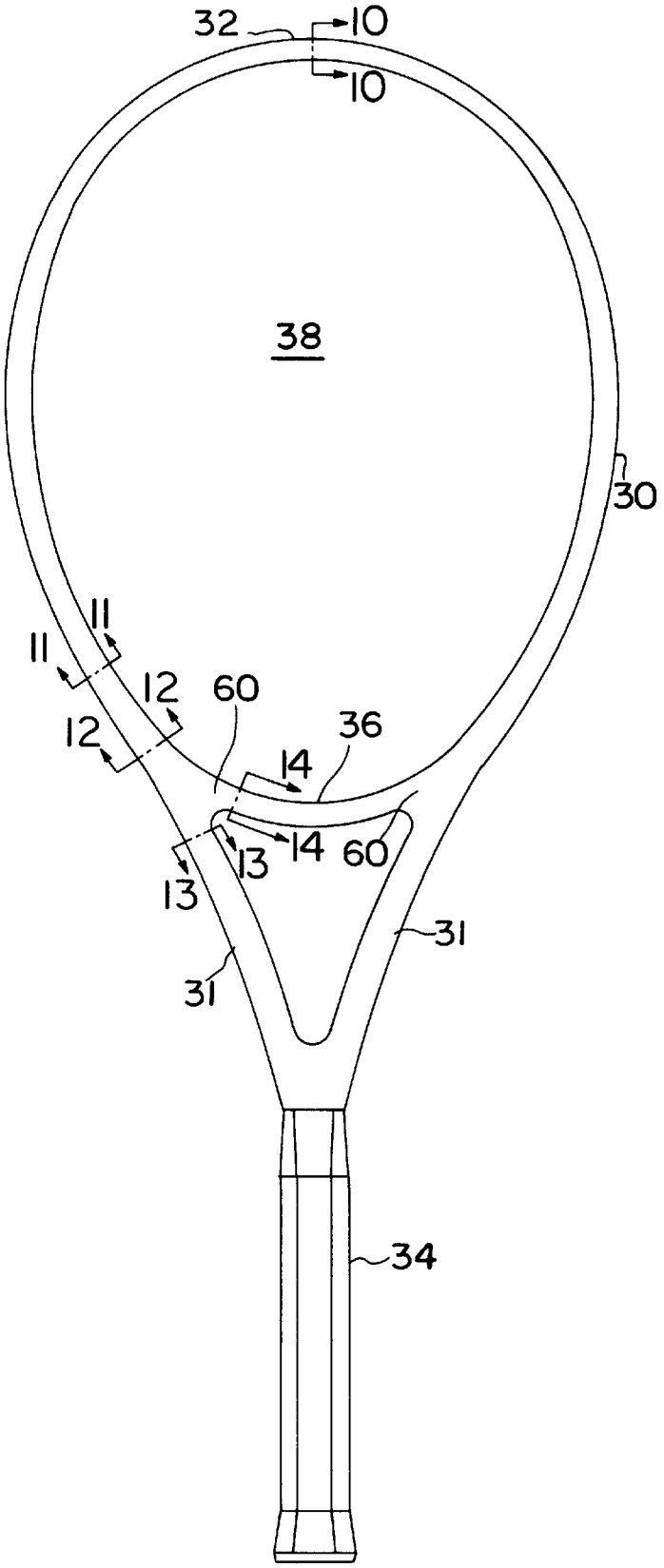
FIGS. 8–9 are front and side views, respectively, of a tennis racquet according to the invention.
Figure 9:
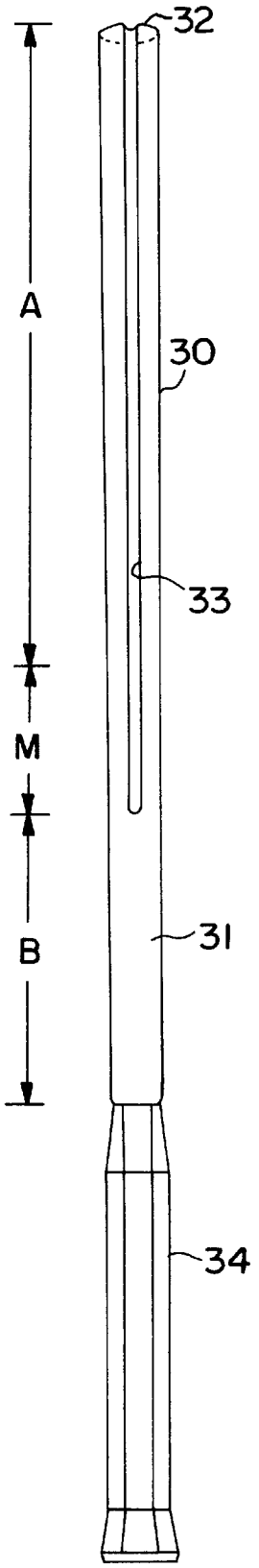

The frame morph region "M" is located starting at the juncture of the throat bridge 36 with the sides of the frame. At the opposite ends 60 of the throat bridge 36, where the throat bridge joins the frame, the frame has a height and width which is the same as the shafts 31. Moving in the direction of the tip, the frame height increases (as shown in FIG. 9), and the width decreases until, upon reaching the location of lines 11—11 in FIG. 8, the frame has taken on the shape shown in FIG. 11. Thus, the morph region "M" coincides with the length of frame where the ends 60 of the throat bridge 36 merge into the head 30, so that the transition of frame shapes occurs simultaneously with the joining of the ends 60 of the throat bridge 36 and the main frame tube 30.

Figure 15:
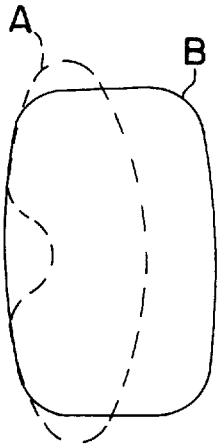
FIG. 15 illustrates the outside frame shapes in the head and shaft regions of the racquet of FIGS. 8–14.

FIG. 15 shows the contrast between frame shapes in the aerodynamic region "A" (shown in broken lines) and the boxy region "B". As illustrated by FIG. 15, in a racquet according to the invention, the frame will perform differently, upon ball impact, in the throat region and head. When a ball impacts the strings, the throat region, formed by shafts 31, resists twisting if the ball lands to either side of the center axis, and allows more flexibility for a softer touch. The head portion of the racquet, in contrast, has a much higher bending stiffness, and thus minimizes any loss of power and racquet distortion in the head portion of the frame.

In the prior art racquet shown in FIG. 1, the two shafts extend axially for a short distance from the handle, and then begin curving outwardly to join the head portion at the throat joint. In contrast, as shown in FIG. 8, in the preferred embodiment of the present invention, the shafts 31 extend from the handle at mutually diverging angles, and extend almost straight to the points where they join the head 30. In the exemplary racquet shown, the shafts 31 extend from the shaft portion at an angle of approximately 10° from the racquet axis, and then curve outwardly with a radius of 575 mm. If desired, however, the shafts 31 may extend straight.

As a result of such geometry, the shafts 31 join the head 30 at locations which are spaced further apart from the racquet axis than the prior art racquet shown in FIG. 1. It has been found that by using relatively straight shafts, having the shafts leave the handle at an angle, and having the shafts join the head at relatively widely spaced locations, the resulting racquet has greater stiffness and control.

A racquet according to the invention may be made using conventional molding techniques for composite frames. In an exemplary process, sheets of uncured epoxy resin, in which unidirectional carbon fibers are embedded (so-called "prepreg"), are wrapped to form a flexible tube. An inflatable bladder is provided inside the tube, and the tube is placed in a mold having the shape of FIG. 8. A prepreg throat bridge is then placed in the mold, and additional prepreg material is wrapped around the ends of the throat bridge and frame to eventually secure the throat bridge ends to the frame. The mold is closed and heated, to cure the epoxy, while at the same time the bladder is inflated to force the tube to assume the shape of the mold. A racquet according to the present invention may be made in accordance with such known process, with the shape of the mold being designed to produce the three regions "A", "B", and "M".

The foregoing represents preferred embodiments of the invention. Variations and modifications will be apparent to persons skilled in the art, without departing from the inventive concepts disclosed herein. All such modifications and variations are intended to be within the skill of the art, as defined in the following claims.

I claim:

1. A sports racquet comprising:

a frame defining a head portion including a tip end and a pair of opposite ends, a handle portion, a pair of converging shaft portions connecting said opposite ends to said handle portion, and a throat bridge spanning said shaft portions to enclose, along with said head portion, a generally planar stringing area;

wherein said frame at any point, has a cross-sectional height in a direction perpendicular to the stringing plane, and a cross-sectional width perpendicular thereto;

wherein said frame has an aerodynamic region, comprising an aerodynamic cross-section, extending from the tip end of said head portion towards said handle portion;

wherein said frame has a box-shape region, comprising a box-type cross-section, extending from said handle portion towards said head portion;

wherein said frame includes a morph region, connecting said box-type region and said aerodynamic region, in which moving in a direction from the head to the shafts the height decreases while the width increases for blending the cross-section of one region into the cross-section of the other region;

wherein said throat bridge includes opposite ends that merge into said head portion and wherein said morph region lies substantially between said throat bridge and said tip end and extends no more than 15% of the length of said racquet such that the transition between said box-shape and aerodynamic regions occurs simultaneously with the merging of the throat bridge opposite ends into said head portion and such that said aerodynamic region encompasses most of said head portion; and wherein the cross-sectional height of the frame immediately adjacent to said morph region is at least 15% greater in said head portion than in said shaft portions such that the bending stiffness of the head in a direction perpendicular to string plane, is greater than the bending stiffness of the shafts.

2. A sports racquet according to claim 1, wherein said morph region extends approximately 10% of the length of said racquet.

3. A sports racquet according to claim 2, wherein the cross-sectional width of the frame immediately adjacent to said morph region is at least 10 percent greater in said head portion than in said shaft portions.

4. A sports racquet according to claim 3, wherein the cross-sectional width of the frame immediately adjacent to said morph region is at least 20 percent greater in said head portion than in said shaft portions.

5. A tennis racquet comprising:

a frame defining a head portion including a tip end and a pair of opposite ends, a handle portion, a pair of converging shaft portions connecting said opposite ends to said handle portion and forming a throat region, and a throat bridge spanning said shaft portions to enclose, along with said head portion, a generally planar stringing area;

wherein said frame, at any point, has a cross-sectional height, in a direction perpendicular to the stringing plane and a cross-sectional width perpendicular thereto;

wherein said frame has an aerodynamic region, comprising an aerodynamic cross-section, extending from the tip end of said head portion towards said handle portion;

wherein said frame has a box-shape region, comprising a box-type cross-section, extending from said handle portion towards said head portion;

wherein said frame includes a morph region, connecting said box-type region and said aerodynamic region in which, moving in a direction from the head to the shafts, the height decreases while the width increases, for blending the cross-section of one region into the cross-section of the other region;

wherein said throat bridge includes opposite ends that merge into said head portion, and wherein said morph region lies substantially between said throat bridge and said tip end and extends no more than 15% of the length of said racquet, such that the transition between said box-shape and aerodynamic regions occurs simultaneously with the merging of the throat bridge opposite ends into said head portion and such that said aerodynamic region encompasses most of said head portion; and wherein the cross-sectional height of the frame immediately adjacent to said morph region is at least 15% greater in said head portion than in said shaft portions, such that the bending stiffness of the head, in a direction perpendicular to string plane, is greater than the bending stiffness of the shafts.

6. A tennis racquet according to claim 5, wherein said morph region extends approximately 10% of the length of said racquet.

7. A tennis racquet according to claim 6, wherein the cross-sectional width of the frame immediately adjacent to said morph region is at least 10 percent greater in said head portion than in said shaft portions.

8. A tennis racquet according to claim 7, wherein said frame, at any point, has a cross-sectional width and a cross-sectional height, and wherein the cross-sectional width of the frame immediately adjacent to said morph region is at least 20 percent greater in said head portion than in said shaft portions.

9. A tennis racquet according to claim 5, wherein said handle portion extends along a racquet axis, and wherein said shaft portions extend from said handle portion at mutually diverging angles of at least approximately 10°.

10. A tennis racquet according to claim 9, wherein said shaft portions have a radius of curvature greater than 500 mm.

* * * * *